US010939755B2

(12) United States Patent
Chiao et al.

(10) Patent No.: US 10,939,755 B2
(45) **Date of Patent: *Mar. 9, 2021**

(54) MODULAR CLOSET SYSTEM

(71) Applicant: Trinity International Industries, L.L.C., Carson, CA (US)

(72) Inventors: Jerry Chiao, Newark, CA (US); Cze-Chao Tam, Palos Verdes, CA (US); Wai Kit Chan, Dongguan (CN); Yinan Yang, Dongguan (CN)

(73) Assignee: TRINITY INTERNATIONAL INDUSTRIES, L.L.C., Carson, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/802,299

(22) Filed: Feb. 26, 2020

(65) Prior Publication Data

US 2020/0187642 A1 Jun. 18, 2020

Related U.S. Application Data

(62) Division of application No. 16/040,306, filed on Jul. 19, 2018.

(Continued)

(51) Int. Cl.
*A47B 57/12* (2006.01)
*A47B 57/18* (2006.01)

(Continued)

(52) U.S. Cl.
CPC ..... *A47B 57/12* (2013.01); *A47B 57/18* (2013.01); *A47B 61/02* (2013.01); *A47B 57/10* (2013.01); *A47B 87/0207* (2013.01); *A47B 96/07* (2013.01)

(58) Field of Classification Search
CPC ..... A47B 57/08; A47B 57/10; A47B 57/12; A47B 57/18; A47B 57/20; A47B 57/22; A47B 87/0207; A47B 96/07; A47B 61/02
See application file for complete search history.

(56) References Cited

U.S. PATENT DOCUMENTS 3,846,002 A * 11/1974 Floetotto ..... A47B 47/04 312/107
4,206,955 A * 6/1980 Cooper ..... A47B 61/00 108/61

(Continued)

*Primary Examiner* — Patrick D Hawn
(74) *Attorney, Agent, or Firm* — Innovation Capital Law Group, LLP; Vic Lin

(57) ABSTRACT

A modular closet system provides reconfigurable closet capacity and an appearance of a customized closet in any of the configurations. The system includes at least two sideframes cooperating to define a space therebetween creating a closet module when assembled. A series of through holes on an inside surface of the sideframes are used to attach a variety of storage devices from the system's sides, which may be re-positioned by user design. When assembled, any of the fasteners used to attach the storage devices are hidden from a front view perspective of the system. Once assembled, the perimeter of the storage devices cooperates with the frames to block the view of the fasteners. Some embodiments may extend closet capacity by including a hanging rod system that connects two frame modules together via the through hole system on respective closet modules, which when assembled also blocks the view of any fasteners.

10 Claims, 10 Drawing Sheets

Related U.S. Application Data

(60) Provisional application No. 62/640,856, filed on Mar. 9, 2018.

(51) Int. Cl.

| | |
|---|---|
| ***A47B 61/02*** | (2006.01) |
| *A47B 87/02* | (2006.01) |
| *A47B 96/07* | (2006.01) |
| *A47B 57/10* | (2006.01) |

(56) References Cited

U.S. PATENT DOCUMENTS 4,540,222 A * 9/1985 Burrell ..... A47F 3/00 211/175
D301,812 S * 6/1989 Handler ..... D6/681.1
5,257,701 A * 11/1993 Edelson ..... A47B 3/10 108/116
5,337,905 A * 8/1994 Gast ..... A47B 61/00 211/105.3
5,348,170 A * 9/1994 Thornley ..... A47B 57/20 108/107
5,350,073 A * 9/1994 Thornley ..... A47B 57/22 108/107
5,495,954 A * 3/1996 Schmit ..... A47B 95/008 211/187
5,582,306 A * 12/1996 Balter ..... A47B 61/00 211/105.1
5,588,540 A * 12/1996 Schmit ..... A47B 95/008 211/187
5,601,016 A * 2/1997 Witte ..... A47B 43/003 108/106
6,029,833 A * 2/2000 Yeh ..... A47F 5/0838 108/108
6,079,803 A * 6/2000 West ..... A47B 45/00 211/186
6,443,318 B1 * 9/2002 Welsch ..... A47B 43/00 211/103
6,681,941 B1 * 1/2004 Johnson ..... A47B 57/00 211/105.1
6,896,341 B2 * 5/2005 Cattoire ..... A47B 61/00 312/205
6,988,628 B2 * 1/2006 Krieger ..... A47B 45/00 211/86.01
7,384,107 B2 * 6/2008 Humberto ..... A47B 57/10 108/193
7,641,063 B2 * 1/2010 Wishart ..... A47B 47/027 211/189
7,762,410 B2 * 7/2010 Colin ..... A47F 5/10 108/107
8,025,164 B2 * 9/2011 Humberto ..... A47B 61/00 211/186
8,579,127 B2 * 11/2013 Dyck ..... A47B 96/068 211/103
9,351,567 B2 * 5/2016 Go ..... A47B 57/08
D776,465 S * 1/2017 Basch ..... D6/675
9,661,920 B2 * 5/2017 Ahart ..... A47B 47/0091
D791,518 S * 7/2017 Basch ..... D6/675
10,443,253 B2 * 10/2019 Taylor ..... E04G 21/3223
10,575,634 B1 * 3/2020 Antonelli ..... A47B 61/003
2003/0150830 A1 * 8/2003 Crown ..... A47B 96/07 211/175
2005/0161419 A1 * 7/2005 Lawson ..... A47F 5/12 211/189
2006/0169659 A1 * 8/2006 Robinson ..... A47B 57/30 211/187
2010/0116762 A1 * 5/2010 Piersant ..... A47B 95/008 211/90.01
2011/0025181 A1 * 2/2011 Vinke ..... A47B 67/04 312/257.1
2011/0088332 A1 * 4/2011 Allis ..... A47B 91/00 52/79.9
2013/0105426 A1 * 5/2013 Dyck ..... A47B 96/068 211/134
2015/0313357 A1 * 11/2015 David ..... A47B 57/20 211/187
2016/0235195 A1 * 8/2016 Ahart ..... A47B 96/06

* cited by examiner

MODULAR CLOSET SYSTEM

RELATED APPLICATION

This application is a divisional of pending U.S. application Ser. No. 16/040,306, filed Jul. 19, 2018, which is hereby incorporated by reference herein in their entirety.

BACKGROUND OF THE INVENTION

Field of the Invention

This invention generally relates to closets, and more particularly, to a modular closet system.

Description of Prior Art and Related Information

Traditional closet systems are static. Conventionally, one had to buy a custom designed closet system that addressed their individual storage needs. In addition, customized closets were aesthetically pleasing as the final assembly typically provides a clean finished appearance with attachment points locked into place and hidden from view. For example, screws might be inserted into a counterbore and capped so as to be hidden from view. This is a permanent attachment because any attempt to remove the screw likely damages the closet surface. These systems become fixtures to the surrounding closet room walls. Once items such as shelves, drawers, and rods are set in place, these items are not moved. The walk-in closet design features are fully contemplated before the system is assembled and once assembled, remain fixed in place. The end product reflects quality in craftmanship and finish.

Freestanding closet systems are typically fully enclosed to provide the same feel as a closet room. Even freestanding closet systems, once assembled, are generally fixed and cannot be re-arranged. Freestanding closet systems are usually mass produced and lack the quality of craftsmanship and design aesthetics of a customized or low volume manufactured piece of furniture. Many closet systems available today are designed to be assembled by the customer (in other words, it is sold unassembled). Unassembled furniture and particularly closets are designed for convenience in assembly. A series of steps guides one to attach dowels or screws to surfaces of the closet pieces. However, the measure of convenience for assembling a closet usually comes at the sacrifice of exposing attachment points (for example, screws, pins, etc. which are readily visible). Once locked in, attempts to remove a fastener typically further exposes the attachment points, damages the structure's finish, and compromises the support structure.

As one's storage capacity needs change, static closet systems become less efficient and more prone to visibly unaesthetic damage to the attachment points. As storage capacity needs change and wear on the closet becomes more apparent, whole closet systems need to be replaced.

As can be seen, there is a need to improve on closet systems so they are more flexible to peoples' changing storage needs yet provide an appearance of a custom closet solution.

BRIEF SUMMARY OF THE INVENTION

In one aspect, a modular closet comprises a first sideframe, the first sideframe including: a first pair of beams positioned parallel to one another, at least one of the first pair of beams including a first beam front face, a first plurality of struts positioned between the first pair of beams supporting the first pair of beams, a plurality of through holes on each of the first pair of beams, the plurality of through holes positioned on an inside facing surface of each the first pair of beams; a second sideframe, the second sideframe including: a second pair of beams positioned parallel to one another, at least one of the second pair of beams including a second beam front face, a second plurality of struts positioned between the second pair of beams supporting the second pair of beams, a plurality of through holes on each of the second pair of beams, the plurality of through holes positioned on an inside facing surface of each of the second pair of beams; a plurality of fasteners configured to fit within the plurality of through holes of the first pair of beams and the plurality through holes in the second pair of beams; and any two of at least a shelf, a first sized drawer, a second sized drawer and a laundry basket configured to fit between the first sideframe and the second sideframe, wherein the shelf, the first sized drawer, the second sized drawer and the laundry basket are repositionable along a height of the first and second sideframes, defined by a space between the first sideframe and the second sideframe, and secured into place within the space by the plurality of fasteners, when the modular closet is in an assembled state, and wherein, none of the plurality of fasteners are visible from a front view perspective of the modular closet when in the assembled state.

In another aspect, a modular closet comprises a first closet module, including: a first sideframe, including a plurality of through holes, and a second sideframe, including a plurality of through holes, a plurality of fasteners configured to fit within the plurality of through holes of the first sideframe and the plurality of through holes of the second sideframe, and a plurality of storage devices configured for attachment between the first sideframe and the second sideframe, the attachment being to the plurality of through holes in the first sideframe and in the second sideframe, wherein: the first sideframe and the second sideframe are configured for modular positioning and repositioning of the plurality of storage devices within the first closet module, and the plurality of fasteners and the plurality of through holes used for attachment of the plurality of storage devices are not visible from a front view perspective of the first closet module when in the assembled state; a second closet module, including: a third sideframe, including a plurality of through holes, and a fourth sideframe, including a plurality of through holes, the plurality of fasteners configured to also fit within the plurality of through holes of the third sideframe and the plurality of through holes of the fourth sideframe, and the plurality of storage devices also configured for attachment between the third sideframe and the fourth sideframe, the attachment being to the plurality of through holes of the third sideframe and to the plurality of through holes of the fourth sideframe, wherein: the third sideframe and the fourth sideframe are configured for modular positioning and repositioning of the plurality of storage devices within the second closet module, and the plurality of fasteners and the plurality of through holes in the second closet module used for attachment of the plurality of storage devices are not visible from a front view perspective of the second closet module when in the assembled state; and a hanging rod configured to be secured between the first closet module and the second closet module.

In yet another aspect, a modular closet comprises a first closet module; a hanging rod coupled to the first closet module by a first end of the hanging rod; a second closet module coupled to the first closet module by a second end of the hanging rod; and a plurality of storage devices configured for modular attachment to attachment points within the first closet module and the second closet module, wherein the attachment points of the plurality of storage devices to the first closet module and to the second closet module are not visible from a front perspective view of the modular closet system when in an assembled state

Figure 1:
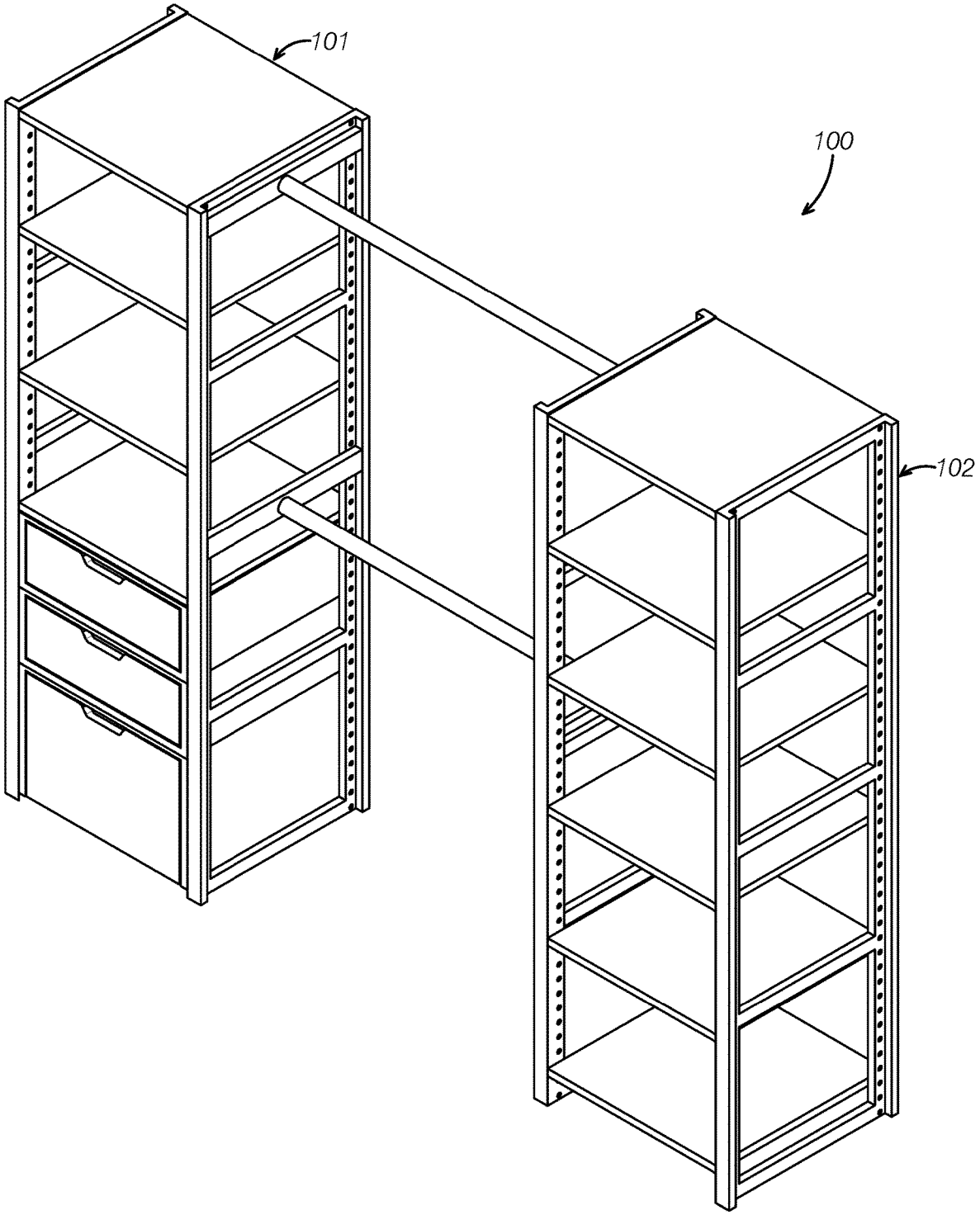
FIG. 1 is a perspective front view of a modular closet system in accordance with an exemplary embodiment.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be apparent to those skilled in the art that the subject technology may be practiced without these specific details. Like or similar components are labeled with identical element numbers for ease of understanding.

In general, embodiments provide a modular closet system that provides an appearance of a custom-made closet with the aesthetic finish of a custom closet yet may be reconfigured at the user's will and still maintain the custom-made look. While aspects of the system quickly and conveniently allow the user to modify their storage needs and adapt the closet as needed, as will be appreciated, the custom-made appearance and clean finish of the closet is maintained during reconfiguration of the closet features. This is the first fully modular closet that allows the user to configure a closet to their needs/wants without needing professional installation. Those assembly embodiments of the closet system will be able to hide attachment points/fasteners from view without needing to know skilled furniture assembly practices for hiding fasteners. The various configurations have front surface of the storage devices flush with the framing creating a clean appearance form the front view perspective.

Embodiments incorporate all different types of storage (for example, drawers of different sizes, shelves, hanging rods, fabric bins, laundry bags, etc.). In addition, aspects of the system may be open faced/open backed providing easy access to switching storage unit types around and facilitating modularity. In some aspects that will be appreciated, the front surfaces of the system may be flush. In some aspects, there may not necessarily be a top, bottom left or right, which may make the system easy to assemble and creates full modularity as storage devices may be moved from one module/location to another without pre-set engineering designs obstructing insertion in to certain points in the framing. Drawers, shelves, hanging bars, and other closet storage devices may be easily added to these frames. Some embodiments may comprise as little as two frames to create a closet module or up to as many frames to build a whole system.

Referring now to FIGS. 1-6, a modular closet system 100 (sometimes referred to as simply the "system 100") is shown according to an exemplary embodiment. Referring to FIG. 1, the system 100 may comprise one or more closet modules 101 and/or 102. In some embodiments, the modules 101 and 102 may be joined together by features of the system 100 to provide more capacity and adaptable storage needs. In some embodiments, the closet modules 101 and 102 may be substantially wooden so that the assembled system 100 provides the impression of a custom-made wooden piece of furniture. While two closet modules (101 and 102) are shown, it will be appreciated that aspects of the system 100 allow the user to add more closet modules as needed to extend storage capacity and provide various storage needs. However, in some embodiments, a closet module 101 or 102 may provide a standalone or freestanding closet which, still provides modularity with storage devices that can be added, removed, switched around and/or swapped out for one another as needed while preserving a custom-made appearance.

Figure 2:
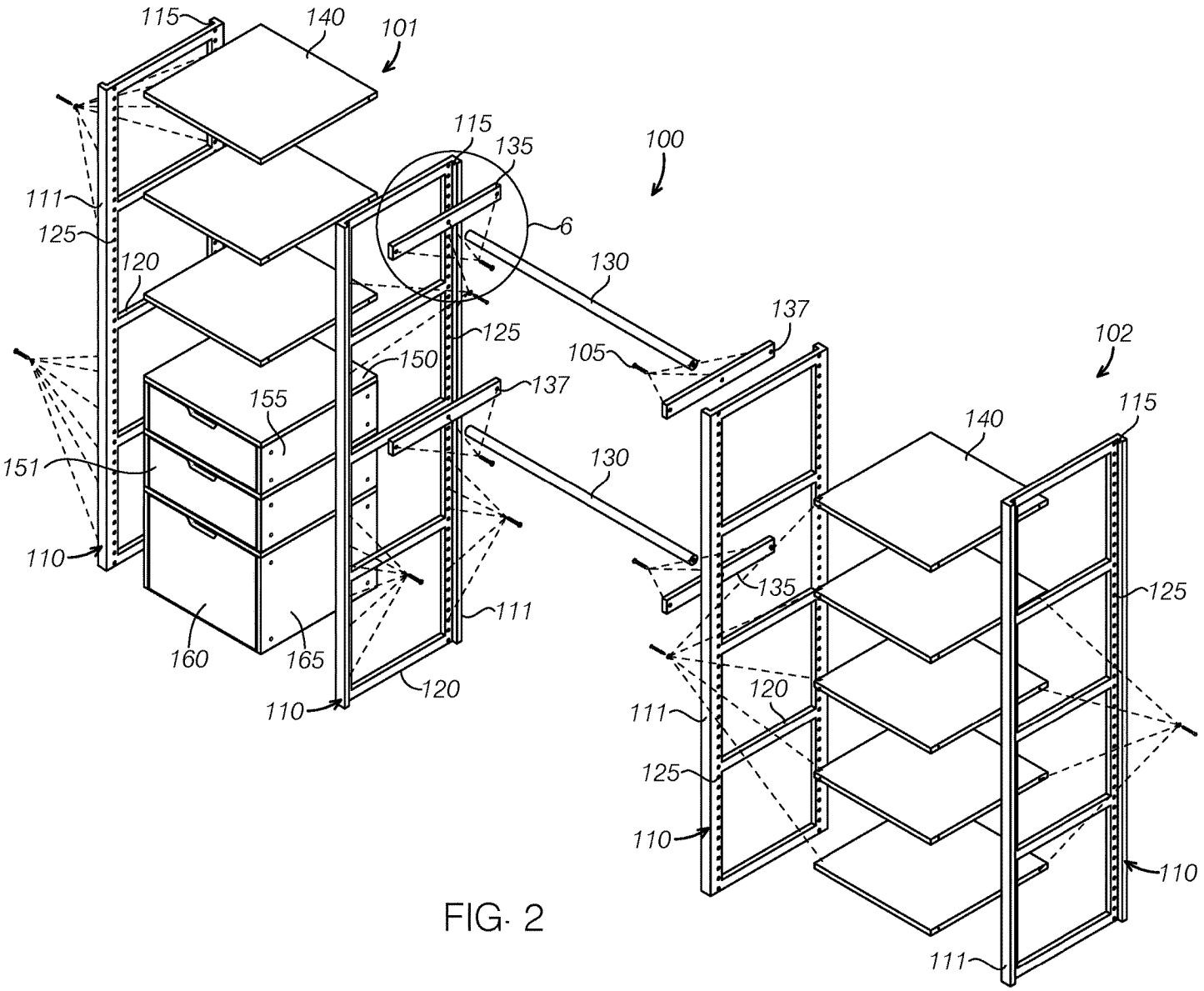
FIG. 2 is an exploded view of the modular closet system of FIG. 1.
Figure 3:
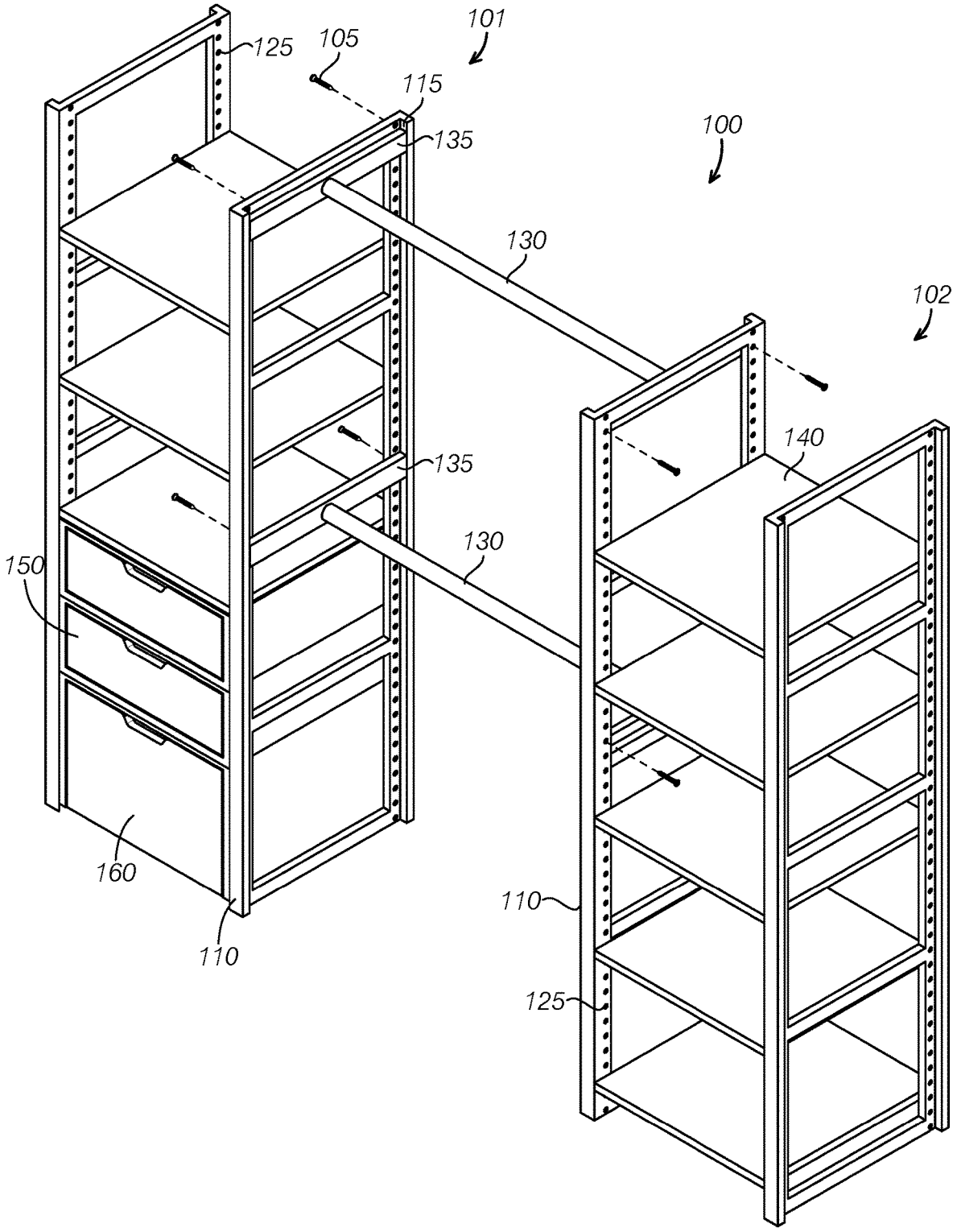
FIG. 3 is an enlarged perspective top front view of the modular closet system of FIG. 1 with top shelves removed.

Referring to FIG. 2, the system 100 is shown exploded to provide additional detail on features that contribute to the modularity and custom-made appearance of the system. In general, each closet module (101, 102, or any succeeding module described), may comprise a pair of sideframes 110. The sideframes 110 may be substantially wooden which, as will be appreciated, contribute to the finished custom-made wooden appearance of the final assembled product. While closet modules 101, 102 (or any other as described later as shown) are shown with pairs of sideframes 110, it will be appreciated that some embodiments may join a third sideframe 110 to the paired sideframes 110 as depicted. For sake of illustration, embodiments daisy chaining sideframes 110 directly together are not shown but will be understood to be contemplated as part of the disclosure and scope of invention.

In general, assembling features of the closet system 100 may be performed by aligning through holes of respective items together and connecting them with fasteners 105 as shown throughout. The fasteners 105 may be for example, screws, bolts, pins, dowels, etc. Some embodiments may include washers 107 (see FIG. 4) which may not be visible in scale within the remaining figures. As will be appreciated, embodiments of the assembled systems hide the fasteners 105 from view by attaching items from the side so that the system gives off the appearance of being custom-made. The fasteners 105 may be removable and reusable to reconfigure the system 100 at will and yet will not be visible thus providing a clean finish in any configuration. In particular, the fasteners 105 and any points of attachment are hidden from the front view which a user would typically see when standing in front of the modular closet system 100. Hiding the points of attachment from the front view gives the closet system 100 the appearance of a custom-made closet.

The sideframes 110 are generally positioned parallel to one another to define an opening therebetween which may include an open face and an open back. A sideframe 110 is generally a box frame with support struts. A sideframe 110 includes a pair of beams 111 positioned parallel to one another generally extending from a floor, upward and struts 120 may be positioned between the beams 111 to provide structural support. Each beam 111 may include a plurality of through holes 125 on an inside surface of the beam disposed for interfacing with side surfaces of storage devices (described below). The through holes 125 may be in series (along a same line) running substantially from one end to the other end of the beam 111. In some embodiments, each sideframe 110 includes a rail 115 on each beam 111. In an exemplary embodiment, the rail 115 may be positioned on a side of the sideframe 110 so that it projects away from an opposing sideframe 110 (for example, toward an exterior direction). The rail 115 may be perpendicular to the inside surface on which the through holes 125 are positioned.

Referring to FIGS. 2, 3, 5, 5A, and 6, in some aspects, the rails 115 define a slot that can be used as a guide for other elements. For example, in embodiments including a hanging rod 130, the hanging rod 130 may include braces 135 on each rod end. The braces 135 may fit into the rail 115 slots so that the hanging rod 130 becomes a bridge between adjacent closet modules 101 and 102. The braces 135 may include through holes 137. The ends of the hanging rod 130 may include a through hole 139 that aligns with a center through hole 137 on the brace 135. The hanging rod 130 and braces 135 may be slid down the slots until alignment with the desired level of through holes 125 on respective sideframe 110 is reached. In some embodiments, the hanging rod 130 and/or the braces 135 may comprised the same wooden finish as the rest of the system 100 to contribute to the custom-made appearance of the closet system. As can be appreciated, one may incorporate multiple hanging rods 130 as shown which provides hanging capacity as needed. Moreover, the hanging rods 130 provide structural support between adjacent closet modules 101 and 102 adding stability to the system 100.

When the closet module 101 or 102 is assembled, a plurality of storage devices may be incorporated by lining up through holes 125 with through holes 155 of respective storage devices. See for example, FIG. 4, where through holes 155 of drawer box 150 are aligned with through holes 125 of the sideframes 110 on both sides of the drawer. The storage devices may be wooden so that when fastened within their sideframe 110, the entire system 100 (or at least a substantial portion), appears to be from the same wooden material as would a custom-made piece of furniture. As will be appreciated, the through holes 125 and the through holes 155 are disposed so as to receive fasteners 105 from the inside and outside surfaces of the beams 111. As storage devices are attached, the fasteners 105 are hidden from view by the outer perimeter surfaces of the storage devices being flush with the inside surface of the beams 111. In addition, the front faces of the storage devices may be flush with a front surface of the beams 111 providing yet another suggestion of the system 100 being a custom-made piece of furniture.

In embodiments including drawers (in the embodiment shown, there may be two differently sized drawers 151 and 160), the drawers are enclosed in a U-shaped box. The slides (not shown) for the drawers are on the inside of the U-shaped boxes 150, 165. The U-shaped boxes 150 and 165 may be removable and reattached at various attachment points along the beams 111. As suggested above, the outer perimeter of the boxes 150 and 165 are flush with the inside surface of the beams 111 so when attached, fasteners 105 are blocked from view when viewing the closet system 100 from the front view perspective. The drawers 151, 160 with the U-shaped enclosure can be moved in increments that fit the holes 125 on the frames (in roughly 1.5" increments). The drawers 151, 160 may be removed and swapped between boxes 150, 165 of the same size enclosure. Accordingly, the drawer boxes 150, 165 may be fully customizable as to where you want to place them on the sideframes 110.

Figure 4:
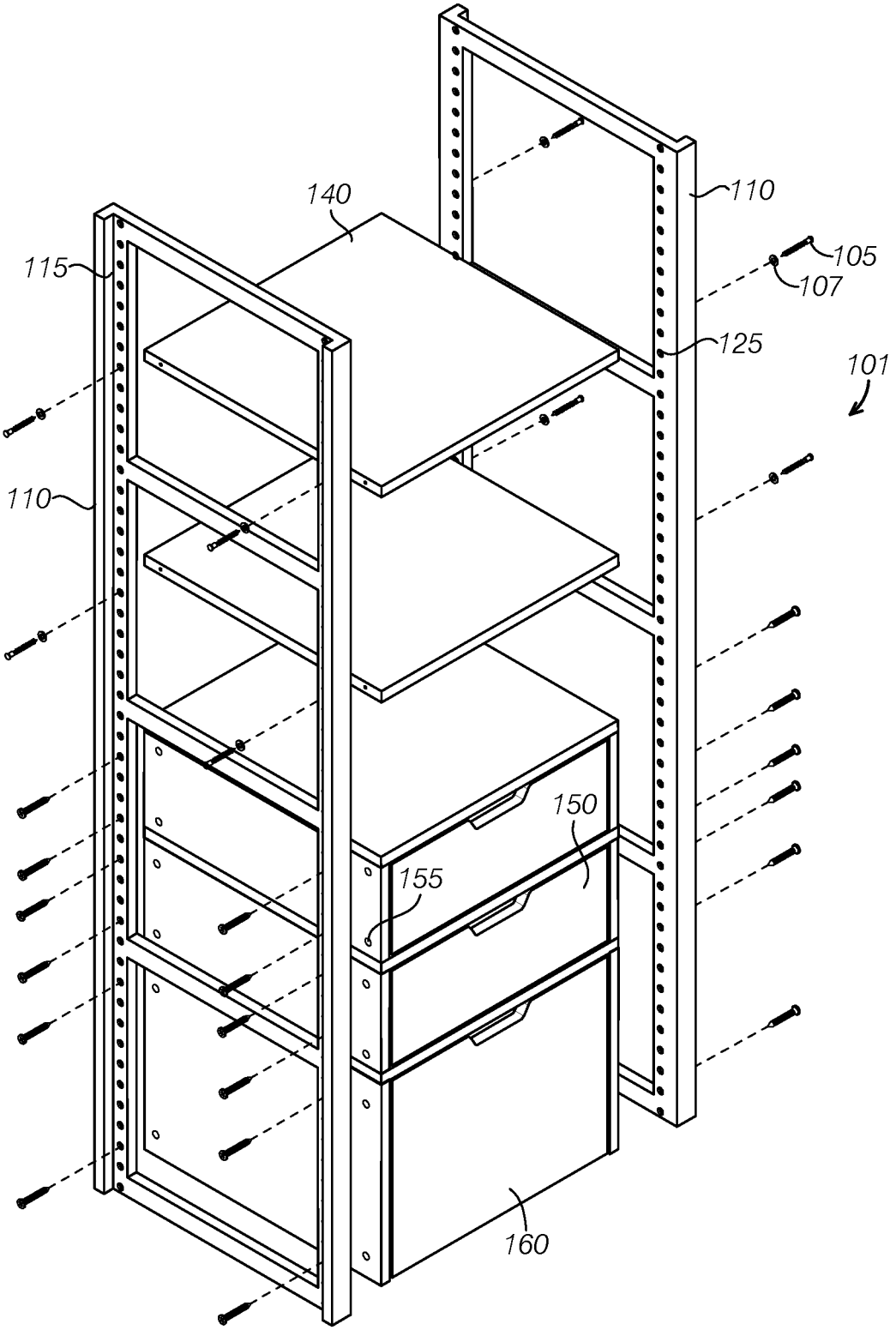
FIG. 4 is an enlarged perspective left side front view of a closet module of FIG. 1.
Figure 5:
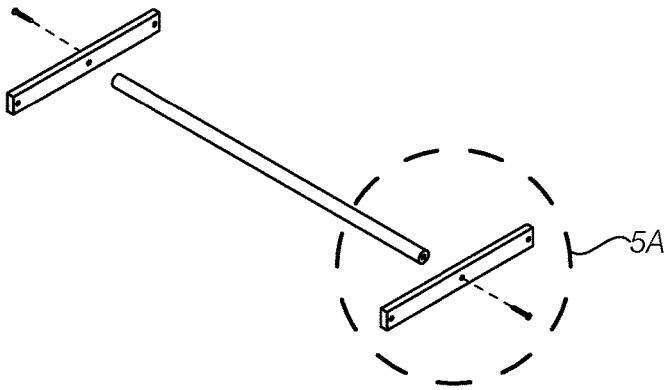
FIG. 5 is an isolated view of a hanging rod system of FIG. 1 in accordance with an exemplary embodiment.
Figure 5A:
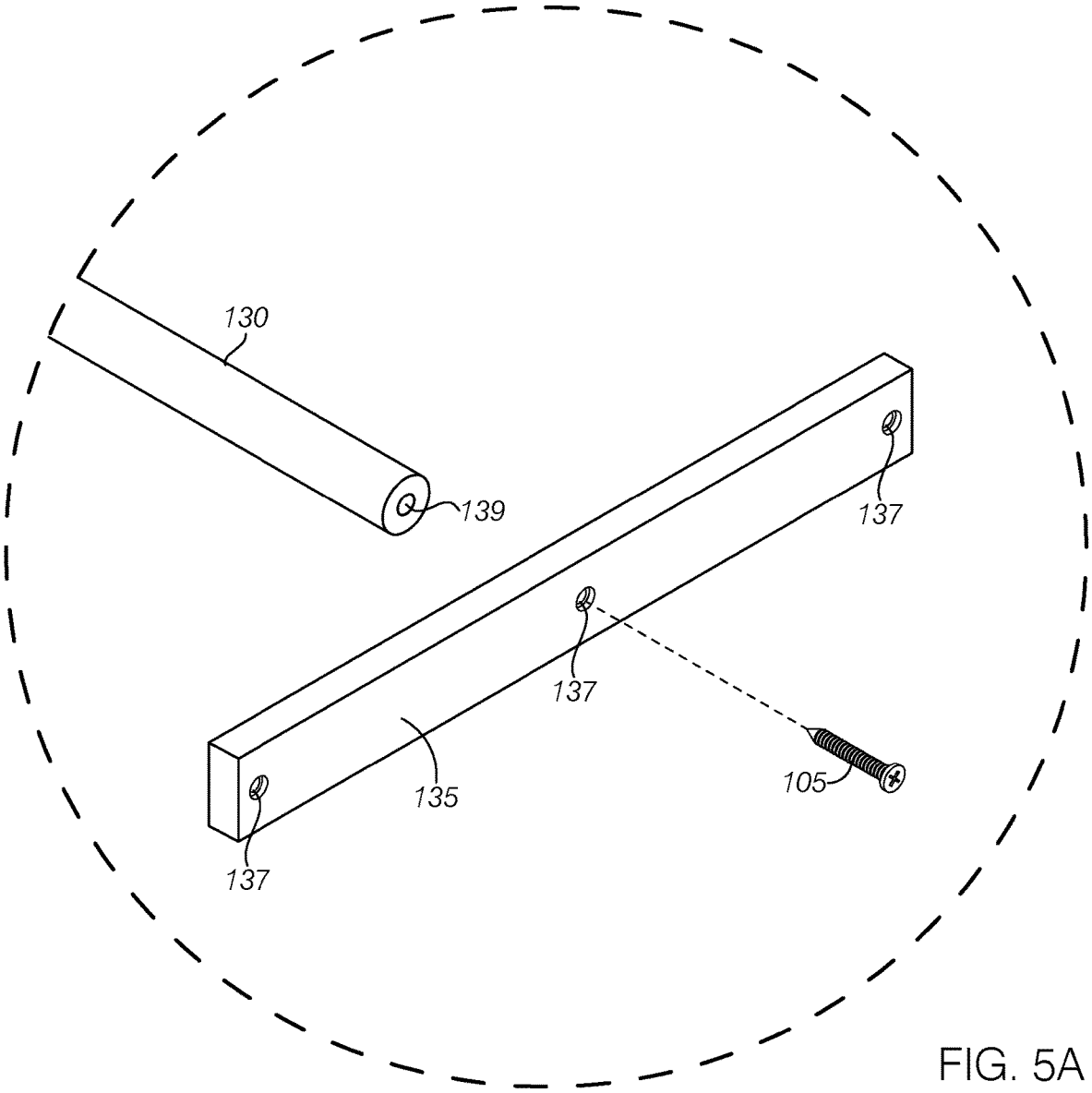
FIG. 5A is an enlarged view of the circle 5A of FIG. 5.
Figure 6:
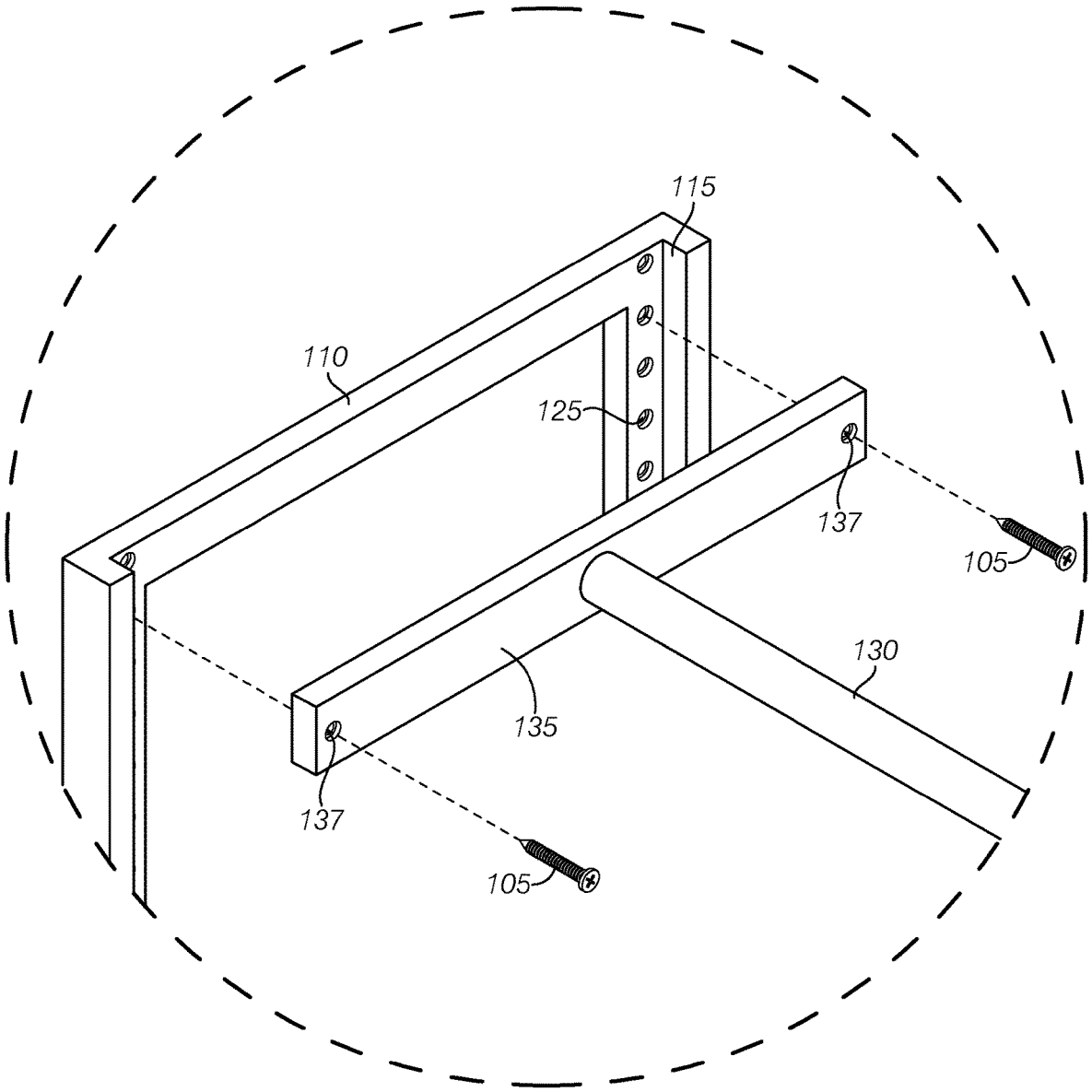
FIG. 6 is an enlarged view of the circle 6 of FIG. 2.

Similarly, other storage devices such as shelves 140 may be positioned between the sideframes 110 based on relation to fastener 105 placement within the through holes 125. For example, FIG. 4 illustrates shelves 140 aligned with through holes 125 and fixed into position by fasteners 105 (and washers 107 as the case may be). However, it will be understood that while the embodiment depicted shows screws for fasteners 105, other embodiments may use instead pins or dowels as the fasteners 105 which may fit within the through holes of the shelves 140, or on top of which the shelves 140 may rest.

Figure 7:
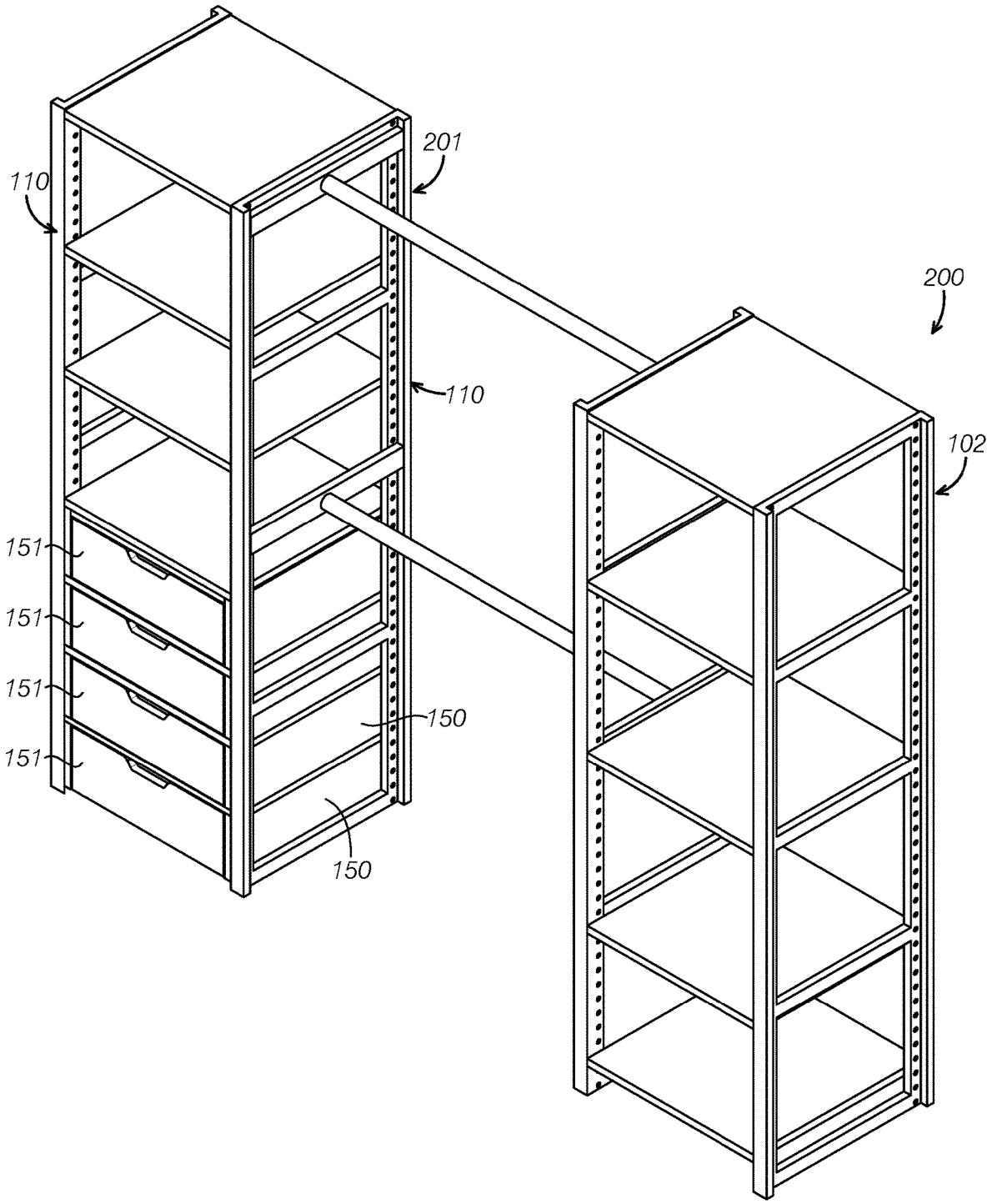
FIG. 7 is a perspective front view of a modular closet system in accordance with another exemplary embodiment.
Figure 8:
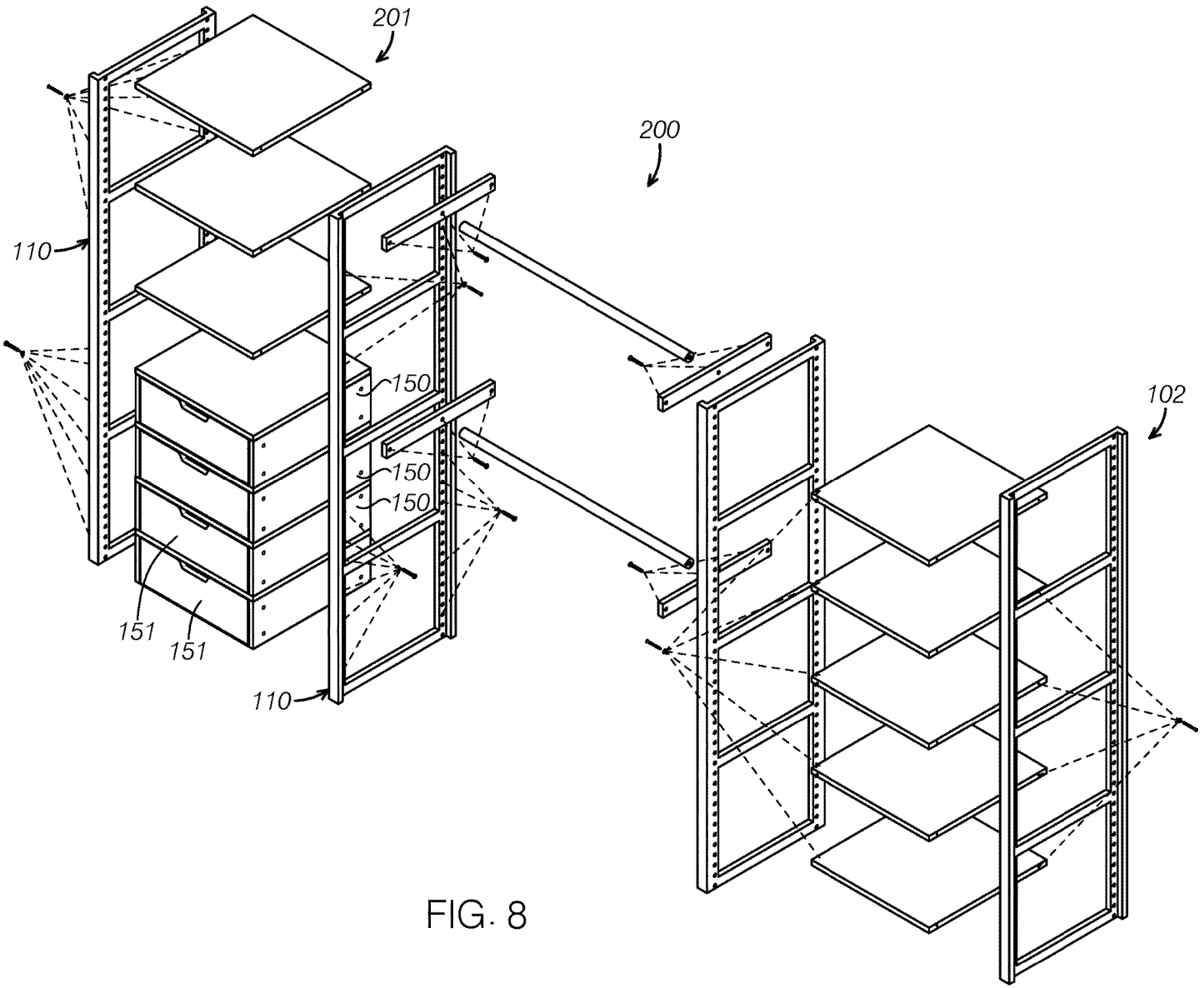
FIG. 8 is an exploded view of the modular closet system of FIG. 7.

Referring now to FIGS. 7 and 8, a modular closet system 200 is shown according to an alternate embodiment. As will be appreciated, the system 200 demonstrates the adaptability of the embodiments disclosed. The system 200 is similar to the system 100 except that closet module 101 is replaced by closet module 201. Closet module 201 is similar to the closet module 101 of FIGS. 1-6 except that the closet module 101 has been re-arranged by means of the modularity of the sideframes and drawer box features. As shown, closet module 201 swapped out the larger sized drawer 160 and drawer box 165 and in its stead, two of the smaller sized drawer boxes 150 and drawers 151 were inserted into and affixed to the sideframes 110.

Figure 9:
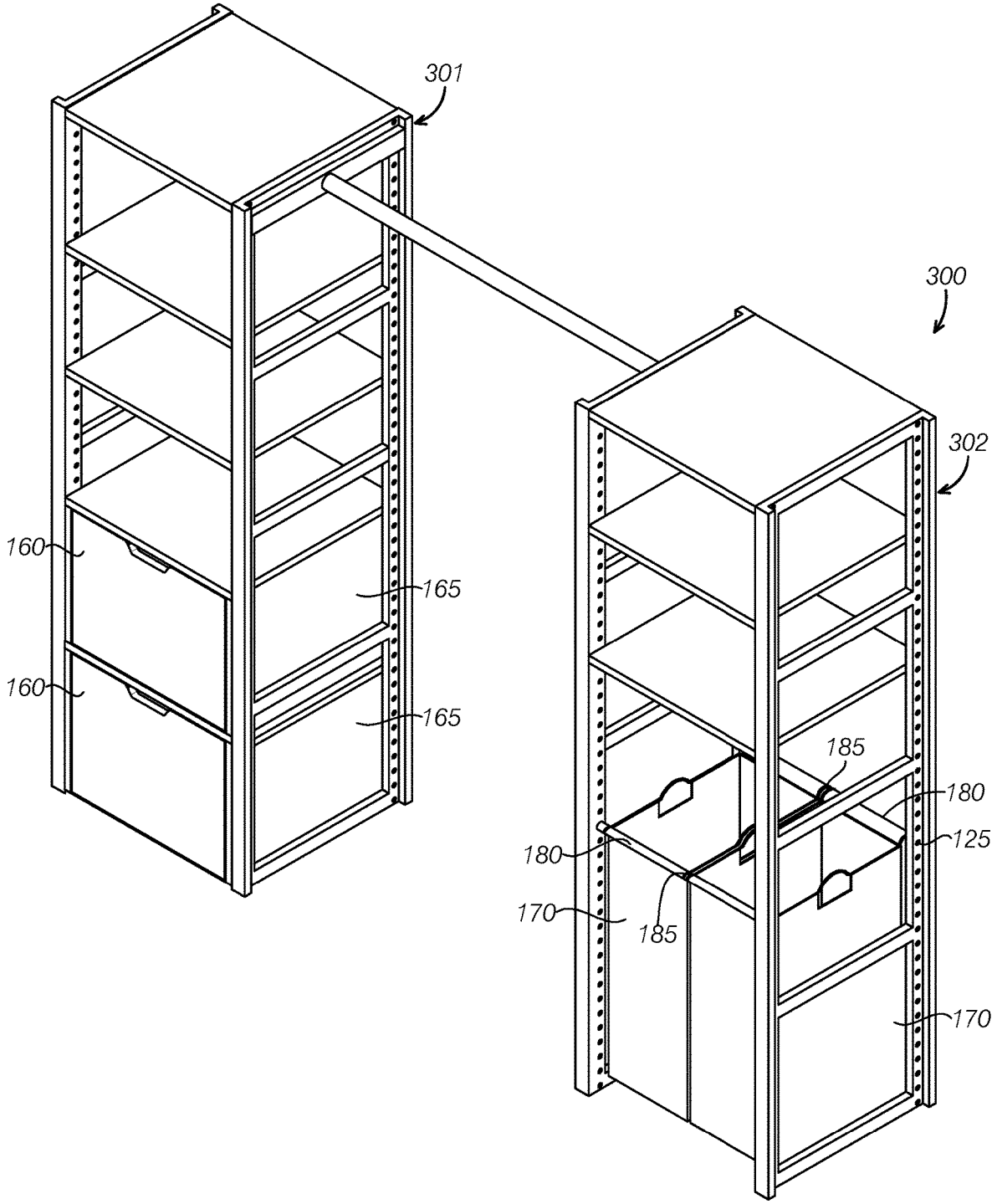
FIG. 9 is a perspective front view of a modular closet system in accordance with another exemplary embodiment.
Figure 10:
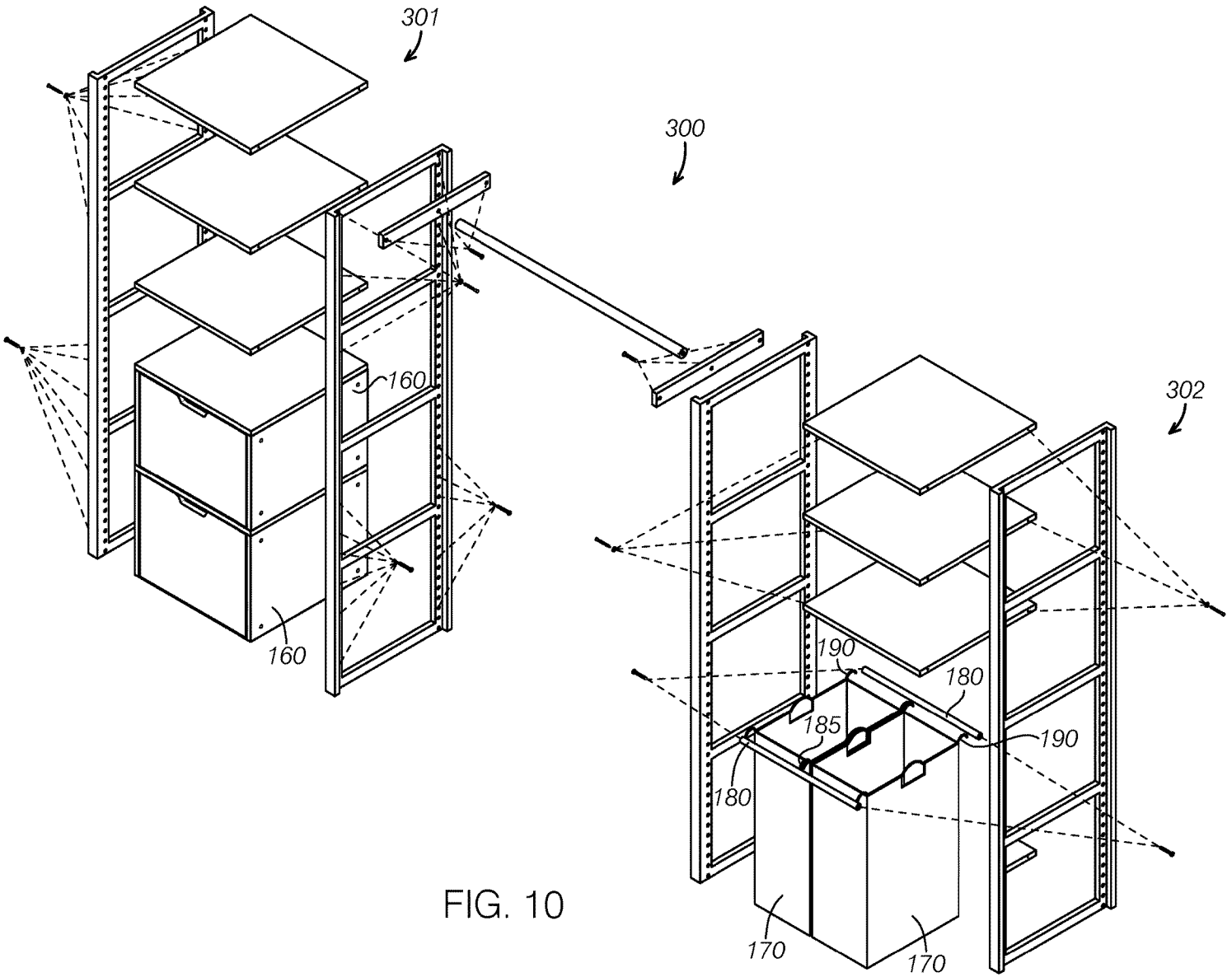
FIG. 10 is an exploded view of the modular closet system of FIG. 9.

FIGS. 9 and 10 illustrate further modularity available by the embodiments. A modular closet system 300 is shown according to an exemplary embodiment which is similar to the embodiments of systems 100 and 200, except that the closet modules are re-arranged to provide alternate storage configurations. A closet module 301 is similar to the closet module 101 except that the two smaller drawer boxes 150 of module 101 have been swapped out and replaced by a second larger sized drawer box 160 and drawer 165. In addition, closet module 102 has been reconfigured as closet module 302 by swapping out lower shelves 140 which are replaced by laundry baskets 170 (another storage type device). Dowel rods 180 may be aligned with the sideframe through holes 125 and fastened into place at the level desired to hang the laundry baskets 170. Typically, a pair of dowel rods 180 may be used so both sides of the baskets 170 have something to hold on to. The laundry baskets 170 may include hangers 190 which hold the baskets 170 onto the dowel rods 180. In some embodiments, where two laundry baskets 170 are used (as shown), a central hanger 185 adjoins the laundry baskets 170 at a common interface so the laundry baskets 170 may become a singular unit for removal. Support is reinforced at the junction of the two baskets 170 by the central hanger 185. If the user desires, one laundry basket 170 may be detached from the other basket and removed or replaced at will. When installed into the closet system, 300 the sides of the laundry baskets 170 may be flush with the inside surfaces of the beams 111 maintaining the custom-made appearance in this embodiment.

As will be appreciated, combinations of the aforementioned features cooperate to create a modular structure which can be re-arranged to form a variety of storage configurations.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense, it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a sub combination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

Terms such as "top," "bottom," "front," "rear," "above," "below" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference. Similarly, an item disposed above another item may be located above or below the other item along a vertical, horizontal or diagonal direction; and an item disposed below another item may be located below or above the other item along a vertical, horizontal or diagonal direction.

A phrase such as an "aspect" does not imply that such aspect is essential to the subject technology or that such aspect applies to all configurations of the subject technology. A disclosure relating to an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such an embodiment may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such a configuration may refer to one or more configurations and vice versa.

The word "exemplary" is used herein to mean "serving as an example or illustration." Any aspect or design described herein as "exemplary" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. A modular closet, comprising:

a first sideframe, the first sideframe including:

a first pair of beams positioned parallel to one another, at least one of the first pair of beams including a first beam front face, a first plurality of struts positioned between the first pair of beams supporting the first pair of beams, a plurality of through holes on each of the first pair of beams, the plurality of through holes positioned on an inside facing surface of each the first pair of beams;

a second sideframe, the second sideframe including:

a second pair of beams positioned parallel to one another, at least one of the second pair of beams including a second beam front face, a second plurality of struts positioned between the second pair of beams supporting the second pair of beams, a plurality of through holes on each of the second pair of beams, the plurality of through holes positioned on an inside facing surface of each of the second pair of beams;

a plurality of fasteners configured to fit within the plurality of through holes of the first pair of beams and the plurality through holes in the second pair of beams, and a first pair of rails projecting from the second sideframe, wherein the first pair of rails define a first slot along a height of the second sideframe; and any two of at least a shelf, a first sized drawer, a second sized drawer and a laundry basket configured to fit between the first sideframe and the second sideframe, wherein the shelf, the first sized drawer, the second sized drawer and the laundry basket are repositionable along a height of the first and second sideframes, defined by a space between the first sideframe and the second sideframe, and secured into place within the space by the plurality of fasteners, when the modular closet is in an assembled state, and wherein, none of the plurality of fasteners are visible from a front view perspective of the modular closet when in the assembled state; and a hanging rod including a first brace on a first end of the hanging rod, wherein the first brace is configured to slide flush against an interior wall of the first slot without horizontal displacement and is secured to the second sideframe by one or more of the plurality of fasteners, wherein fasteners are used to secure the first brace to the second sideframe and are not visible from the front view perspective of the modular closet when in the assembled state.

2. The modular closet of claim 1, wherein the first beam front face and the second beam front face are flush with a front face of shelf, a front face of the first sized drawer, and a front face of the second sized drawer.

3. The modular closet of claim 1, further comprising a first box configured to hold the first sized drawer and a second box configured to hold the second sized drawer, wherein the first sized box and the second sized box block a view of the fasteners when the modular closet is in the assembled state.

4. The modular closet of claim 1, further comprising:

a third sideframe, the third sideframe including:

a third pair of beams positioned parallel to one another, at least one of the third pair of beams including a third beam front face, a third plurality of struts positioned between the third pair of beams supporting the third pair of beams, a plurality of through holes on each of the third pair of beams, the plurality of through holes positioned on an inside facing surface of each the third pair of beams;

a fourth sideframe, the fourth sideframe including:

a fourth pair of beams positioned parallel to one another, at least one of the fourth pair of beams including a fourth beam front face, a fourth plurality of struts positioned between the fourth pair of beams supporting the fourth pair of beams, a plurality of through holes on each of the fourth pair of beams, the plurality of through holes positioned on an inside facing surface of each the fourth pair of beams;

a plurality of fasteners configured to fit within the plurality of through holes of the fourth pair of beams and the plurality through holes in the fourth pair of beams; and wherein the hanging rod includes a second brace on a second end of the hanging rod, wherein the second brace is configured to be secured to a second slot in the third sideframe by one or more of the plurality of fasteners, wherein fasteners used to secure the first brace to the second sideframe and the second brace to the third sideframe are not visible from the front view perspective of the modular closet when in the assembled state.

5. The modular closet of claim 4, wherein the hanging rod is repositionable along a height between the second sideframe and the third sideframe.

6. A modular closet system, comprising:

a first closet module, including:

a first sideframe, including a plurality of through holes, and a second sideframe, including a plurality of through holes, a plurality of fasteners configured to fit within the plurality of through holes of the first sideframe and the plurality of through holes of the second sideframe, and a plurality of storage devices configured for attachment between the first sideframe and the second sideframe, the attachment being to the plurality of through holes in the first sideframe and in the second sideframe, wherein:

the first sideframe and the second sideframe are configured for modular positioning and repositioning of the plurality of storage devices within the first closet module, and the plurality of fasteners and the plurality of through holes used for attachment of the plurality of storage devices are not visible from a front view perspective of the first closet module when in the assembled state;

a second closet module, including:

a third sideframe, including a plurality of through holes, and a fourth sideframe, including a plurality of through holes, the plurality of fasteners configured to also fit within the plurality of through holes of the third sideframe and the plurality of through holes of the fourth sideframe, and the plurality of storage devices also configured for attachment between the third sideframe and the fourth sideframe, the attachment being to the plurality of through holes of the third sideframe and to the plurality of through holes of the fourth sideframe, wherein:

the third sideframe and the fourth sideframe are configured for modular positioning and repositioning of the plurality of storage devices within the second closet module, and the plurality of fasteners and the plurality of through holes in the second closet module used for attachment of the plurality of storage devices are not visible from a front view perspective of the second closet module when in the assembled state; and a hanging rod configured to be secured between the first closet module and the second closet module, wherein a first end of the hanging rod is configured to slide flush against a wall of the second sideframe without horizontal displacement when repositioning the hanging rod along a height between the first closet module and the second closet module.

7. The modular closet system of claim 6, wherein the first closet module and the second closet module are substantially wooden.

8. The modular closet system of claim 6, wherein:

the plurality of through holes in the first closet module are on inside surfaces of the first and second sideframes, and the plurality of through holes in the second closet module are on inside surfaces of the third and fourth sideframes.

9. The modular closet system of claim 6, wherein the plurality of storage devices includes any two of at least a shelf, a first sized drawer, a second sized drawer and a laundry basket.

10. The modular closet system of claim 6, wherein a front face surface of the first closet module is flush with a front face surface of respective storage devices.

* * * * *